United States Patent [19]

Martin

[11] 4,321,814

[45] Mar. 30, 1982

[54] HAND TOOL FOR SETTING THREADED FASTENERS

[76] Inventor: Alan Martin, 42 Lantern La., Sharon, Mass. 02067

[21] Appl. No.: 172,274

[22] Filed: Jul. 25, 1980

[51] Int. Cl.[3] ..... B21J 15/34

[52] U.S. Cl. ..... 72/114; 72/391

[58] Field of Search ..... 72/114, 391, 454; 29/243.53, 243.54

[56] References Cited

U.S. PATENT DOCUMENTS

| | | | |
|---|---|---|---|
| 2,723,777 | 11/1955 | Amtsberg | 72/114 |
| 3,008,598 | 11/1961 | Martin | 72/391 |
| 3,197,987 | 8/1965 | Martin | 72/114 |
| 3,686,915 | 8/1972 | Miller | 72/114 |
| 4,070,889 | 1/1978 | DeCaro | 72/114 |

*Primary Examiner*—Gene P. Crosby

*Attorney, Agent, or Firm*—Wolf, Greenfield & Sacks

[57] ABSTRACT

A power hand tool for setting internally threaded rivets comprising a housing having a motor which drives a mandrel that screws into the rivets and compresses them against an anvil forming part of the housing. The connection between the motor and mandrel includes a spindle driven by the motor and having a chamber at one end which receives a mandrel driver that in turn carries the mandrel. A spring in the chamber behind the driver yieldably urges the mandrel in the direction of the rivet to be set on the mandrel.

6 Claims, 6 Drawing Figures

HAND TOOL FOR SETTING THREADED FASTENERS

INTRODUCTION

This invention relates to portable hand tools for setting blind fasteners and comprises an improvement over the tools disclosed in my earlier U.S. Pat. No. 3,008,598 issued Nov. 14, 1961 and No. 3,197,987 issued Aug. 3, 1965. Blind fasteners, that is, screw-type rivets, made of aluminum, steel or brass are used extensively in the electronics, aircraft, automative, aluminum, and other industries for the attachment of printed circuit boards (pcb's) and many other parts.

One important object of this invention is to provide a light weight hand tool that has fewer parts than those presently available and is therefore less expensive to manufacture.

Another important object of this invention is to provide a labor saving tool whereby any kind of threaded blind expandable fastener may be handled by a single tool from one side of work.

More specifically an object of this invention is to provide a tool which is easily and readily adjustable to accommodate rivets having different thread pitches and work of different thickness. That is, the thread pitch as well as grip range or how deeply the rivet is engaged by the tool may be quickly changed, thereby increasing productivity and lowering the final cost of the finished product.

Yet another important object of this invention is to provide a rivet setting tool in which the mandrel engages the rivet thread gently so as to absorb the initial shock of impact and to ensure proper threading alignment.

To accomplish these and other objects, the tool of this invention includes a shaft assembly driven by a motor and which when rotated in one direction engages and sets a rivet and when turned in the opposite direction disengages from the set rivet. The stall torque of the motor is such that the rivet is fully set before the motor cuts off.

These and other objects and features of this invention will be more fully understood from the following detailed description of a preferred embodiment thereof and shown in the accompanying drawings in which:

BRIEF FIGURE DESCRIPTION

DETAILED DESCRIPTION OF THE DRAWINGS

Figures 1, 2, 3, 4, 5, 6:
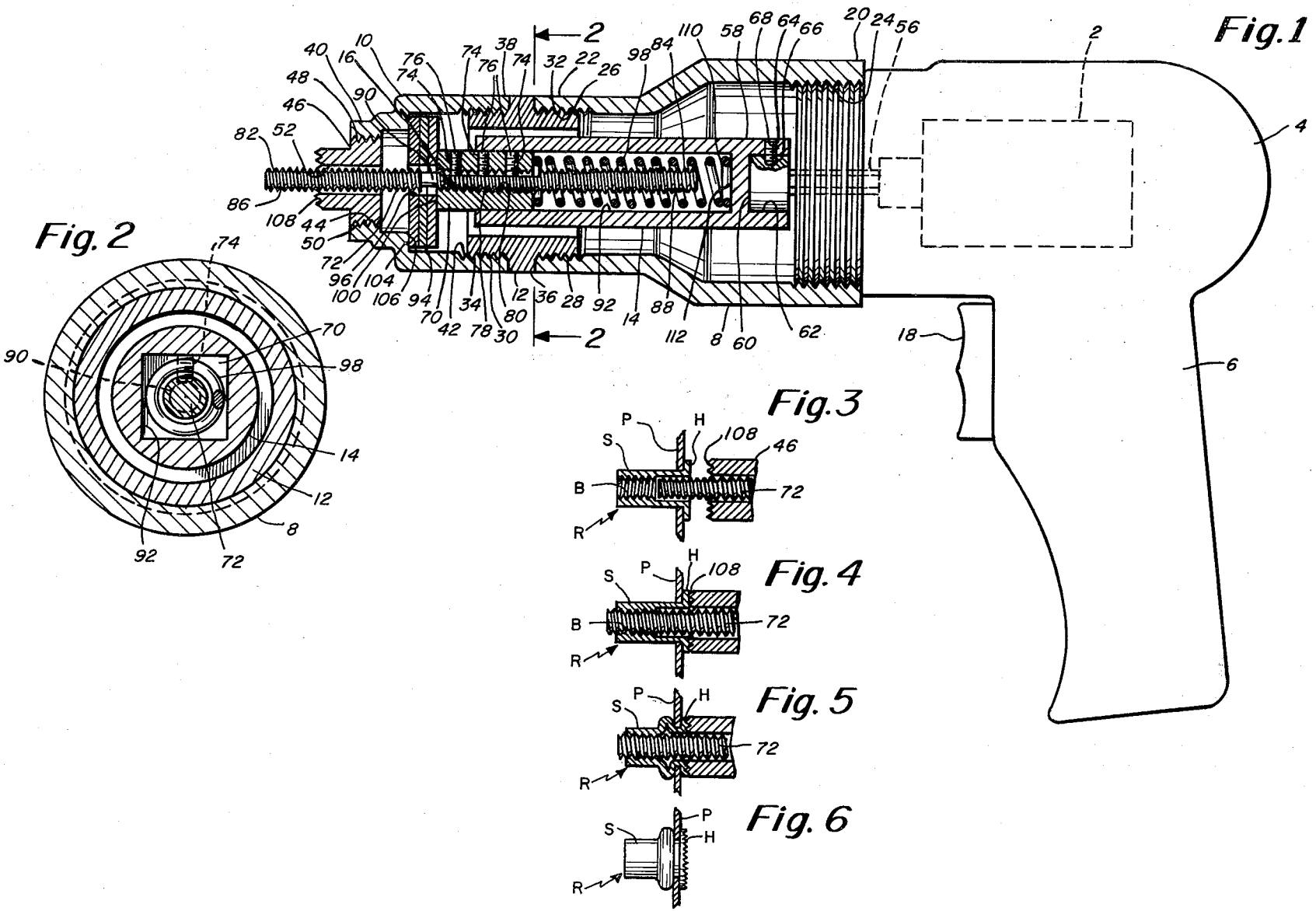
FIG. 1 is a cross-sectional view of a threaded rivet setting hand tool, constructed in accordance with this invention.
FIG. 2 is a cross-sectional view taken along the corresponding section line in FIG. 1.
FIGS. 3 to 6 illustrate the sequence of steps in setting a rivet nut as performed by the tool shown in FIGS. 1 and 2.

The embodiment of this invention shown in FIG. 1 includes a motor 2 within a motor case 4, a handle 6 attached to the motor case, a housing composed of two coaxial sections 8 and 10 joined by coupler 12, and a shaft composed of two sections 14 and 16. Section 14 has an internal axially extending chamber which is square in cross-section and section 16 has a square end slidable in the chamber as is more fully described below. The motor 2 is pneumatically operated and has a rocker switch actuator 18. When one end of rocker switch 18 is depressed, the motor rotates in one direction and when the other end is depressed, the motor rotates in the opposite direction.

Housing section 8 is internally threaded at both ends 20 and 22 with left hand threads 24 and 26. The end 20 is screwed onto motor case 4. Coupler 12, which joins the housing sections 8 and 10, is externally threaded at both ends 28 and 30 with left hand threads 32 and 34 and carries a flange 36 around its central portion. End 32 is threaded into end 22 of housing section 8. Housing section 10 is internally threaded at both ends 38 and 40 with left hand threads 42 and 44. The end 38 of housing section is threaded onto end 34 of coupler 12. Flange 36 provides a gripping surface for attaching as well as removing coupler 12 from the housing sections, and also acts to fill the gap between sections 8 and 10 when the housing is assembled providing the tool with a relatively smooth outer surface. Anvil 46 is externally threaded at end 48 with left hand thread 50. End 48 is threaded into the end 40 of housing 10. Bore 52 runs through the anvil 46 along its longitudinal axis.

Shaft 14 is composed of short shaft 56 and spindle 58. A bore 62 in spindle 58 receives the end 60 of short shaft 56. The shaft and spindle are locked together by aligning keyways 64 and 66 and inserting key 68.

Shaft 16 includes reversible, adjustable mandrel driver 70 and mandrel 72. Driver 70 has an axially extending threaded bore 78 and three threaded holes 74 that radially meet bore 78 and accommodate set screws 76. Ends 82 and 84 of the mandrel carry right-hand threads 86 and 88, and the ends are separated by a short unthreaded section 90. A flat 91 is provided on the threads 88, which is engaged by the set screws. The threads 88 are sized to mate with threaded bore 78 of the driver, and all mandrels intended to be used with the tool will have the same threads at that end, while the other threads on the mandrels may be of different size to accommodate a variety of different fasteners. The set screws 76 of course lock the mandrel to the driver but permit the mandrel to be changed. Driver 70 is slidably mounted in axially extending chamber 92 of spindle 58. In the preferred embodiment, both the chamber 92 and the driver 70 have square cross-sections.

A bearing set 94 having an axial bore 96 is rotatably secured in coaxial alignment within housing 10. The forward end 82 of mandrel 72 extends through the bore 96 as well as the bore 52 in anvil 46.

A coil spring 98 housed within the chamber 92 of spindle 58 biases the driver 70 against the face 102 of bearing 94 and also biases the face 104 of bearing 94 against the rim 106 of housing 10. Thus, driver 70 may freely rotate while being urged towards its extreme forward position.

The function of the hand tool is illustrated in FIGS. 3 to 6. In FIG. 3 a threaded rivet R having a stem S and head H is shown extending through an opening in plate P in which the rivet is to be permanently affixed. The operator holds the tool so that the end 82 of mandrel 72 extends into the central bore B of the rivet. The anvil face 108 is shown spaced from the head H of the rivet. Next, the operator depresses one end of a rocker switch 18 so as to cause the motor and shaft assemblies to rotate in a clockwise direction. The end of the mandrel 82 comes into contact with rivet R, the force of impact is transmitted back through shaft section 16 so as to compress coil spring 98 and thereby isolate the shock of impact from the hands of the tool operator. If the tool is not in proper alignment with bore B of rivet fastener R as the operator presses the tool forward, the resistance to threading depresses coil spring 98, thereby protecting against cross threading of threaded end 86 within the threaded portion of bore B. With the end 82 of the mandrel inserted with proper alignment as shown in FIG. 3, the operator pushes the tool forward so that the anvil face 108 comes into contact with the rivet head H. This is done faster than thread 86 can screw into the threaded portion of rivet R, thereby forcing shaft section 14 towards the rearward end of the tool, causing driver 70 to slide further into the chamber 92 of spindle 58 and compressing coil spring 98. As the mandrel screws into the fastener, shaft section 14 with its driver 70 moves toward the forward end of the tool until stopped by the contact of the face 100 of driver 70 with the face 102 of bearing 94. That position of the mandrel 72 is depicted in FIG. 4. As can be seen in FIG. 4, anvil face 108 bearing against the head H of the rivet prevents the rivet from rotating, and as the mandrel 72 cannot screw deeper into the rivet, a substantial pull is applied to the rivet causing it to crimp or set in the manner shown in FIG. 5. The crimping and setting of the rivet R continues with rotation of the motor until the stall torque feature of the motor causes the motor to stall due to the load applied to it by virtue of the resistance to further rearward movement of the rivet with the shaft. The amount of load required for the motor to stall is a function of the pressure setting on the air regulator attached to the motor. Thus, if a relatively large fastener or one made of a particularly hard material is to be set, the setting of the pressure regulator is increased, and when a smaller fastener or one made of a softer material is to be set, the pressure setting on the pressure regulator is decreased.

With the rivet set as shown in FIG. 5, the operator depresses the other end of a rocker switch 18 causing the motor to rotate in the opposite or counterclockwise direction. This causes shaft 16 to disengage from the rivet and pushes driver 70 further into the chamber 92 of spindle 58, thereby depressing the coil spring 98. The rearward end 110 of the coil spring pushes against the surface 112 of spindle 58, thereby softly and comfortably urging the hand tool into the hands of the operator. The operator then need only guide the tool out of the threaded rivet. When the tool is completely disengaged, the operator places rocker switch 18 in its neutral position causing the motor to stop rotating, and the tool is then ready to set the next rivet. The set rivet is mounted as shown in FIG. 6 and is in a condition to receive a screw which will in turn support any desired article on the plate P.

From the foregoing, it should be appreciated that continued rotation of the shaft assembly in one direction causes the end 82 of mandrel 72 to take up the rivet and crimp it, and after the crimping operation is completed the direction of rotation is reversed to unscrew the mandrel from the crimped rivet. This action is basic to my earlier patents, supra and is here utilized in a more sophisticated tool which has many advantages over the tools described in those patents. The multiple clutches of the prior art tools have been eliminated, thereby reducing the weight of the tool. Shaft sections 14 and 16 are urged apart by coil spring 98, eliminating any tendency for the fastener to be cross threaded on the mandrel. The coil spring 98 also absorbs the impacts that occur during use, making the tool more comfortable and less tiring to use over the course of a normal work shift. Finally, section 10 may be removed and mandrel 72 may be repositioned in the driver to accommodate fasteners of different lengths, or the mandrels may be replaced with another mandrel of different diameter, length and/or pitch. This feature enables the operator to quickly and easily adjust the tool so that it can be used on other types and lengths of threaded blind rivet-type fasteners.

From the foregoing description, it will be appreciated that the hand tool of this invention is capable of performing all of the objects set forth in the introduction. Because of the numerous modifications of the present invention that will occur to those skilled in the art, it is not intended that this invention be limited to the preferred embodiment illustrated and described. Rather, it is intended that the scope of this invention be determined by the following claims and their equivalents.

I claim:

1. A power hand tool for setting internally threaded rivets comprising a generally cylindrical housing and a motor mounted in the housing adjacent one end thereof, a spindle disposed in the housing adjacent to the motor and connected to the motor to be rotated by it, an axially extending chamber of non-circular cross section in the spindle open at the spindle end away from the motor, a mandrel driver mounted in the chamber and having a cross section complimentary to the chamber so that the driver will rotate with the spindle, a mandrel secured to and extending axially from the driver to be rotated by said driver, said mandrel being threaded at its end away from the driver, an anvil secured to the end of the housing away from the motor and having a central opening through which the mandrel extends, a spring disposed in the chamber behind the driver for yieldably urging the mandrel in the direction of the anvil and acting as a shock absorber to allow the mandrel to move rearwardly toward the motor, and said motor connecting said spindle for stopping, starting and reversing its direction of rotation.

2. A power hand tool for setting internally threaded rivets as defined in claim 1 further characterized by said motor being a pneumatic stall torque motor.

3. A power hand tool for setting internally threaded rivets as defined in claim 1 further characterized by said mandrel being removably secured to the driver so that mandrels of different length and diameter and thread pitch may be substituted for one another.

4. A power hand tool for setting internally threaded rivets as defined in claim 1 further characterized by said housing including rear and front sections joined together by a body coupler that screws onto the two sections, a pistol grip type handle secured to the rear section of the housing, and a trigger switch on the handle for controlling the motor.

5. A power hand tool for setting internally threaded rivets as defined in claim 4 further characterized by said motor being a pneumatic stall torque motor and said mandrel being removably secured to the driver so that mandrels of different length and diameter and thread pitch may be substituted for one another.

6. A power hand tool for setting internally threaded rivets as defined in claim 5 further characterized by the threaded end of the mandrel having right hand threads.

* * * * *